US007082704B2

(12) United States Patent
Throneburg et al.

(10) Patent No.: US 7,082,704 B2
(45) Date of Patent: Aug. 1, 2006

(54) INSOLE, AND FOOTWEAR SYSTEM INCORPORATING SAME

(75) Inventors: James L. Throneburg, 635 Hauser Rd., Lewisville, NC (US) 27023; Louis J. Panaccione, Dedham, MA (US)

(73) Assignee: James L. Throneburg, Lewisville, NC (US)

( * ) Notice: Subject to any disclaimer, the term of this patent is extended or adjusted under 35 U.S.C. 154(b) by 171 days.

(21) Appl. No.: 10/903,161

(22) Filed: Jul. 30, 2004

(65) Prior Publication Data

US 2006/0021252 A1 Feb. 2, 2006

(51) Int. Cl.
*A43B 7/22* (2006.01)

(52) U.S. Cl. ..... 36/91; 36/28; 36/31; 36/44; 36/25 R

(58) Field of Classification Search ..... 36/91, 36/28, 31, 44, 25 R
See application file for complete search history.

(56) References Cited

U.S. PATENT DOCUMENTS 3,169,327 A * 2/1965 Fukuoka ..... 36/34 R
4,808,469 A 2/1989 Hiles
4,831,750 A * 5/1989 Muller ..... 36/28
4,910,886 A 3/1990 Sullivan et al.
5,014,706 A 5/1991 Philipp
5,068,983 A 12/1991 Marc
5,146,698 A 9/1992 Tilles et al.
5,184,409 A 2/1993 Brown
5,311,677 A 5/1994 Mann et al.
5,335,517 A * 8/1994 Throneburg et al. ..... 66/185
5,435,078 A * 7/1995 Pyle ..... 36/30 R
D362,956 S 10/1995 Martin et al.
5,542,196 A 8/1996 Kantro
5,586,398 A * 12/1996 Carlson ..... 36/114
5,595,005 A * 1/1997 Throneburg et al. ..... 36/91
5,619,809 A * 4/1997 Sessa ..... 36/3 R
5,669,162 A 9/1997 Dyer
D396,948 S 8/1998 Moore et al.
6,038,790 A * 3/2000 Pyle et al. ..... 36/30 R
6,120,880 A * 9/2000 Crow ..... 428/167
6,131,311 A 10/2000 Brown et al.

(Continued)

FOREIGN PATENT DOCUMENTS

DE 3439675 4/1986

(Continued)

OTHER PUBLICATIONS

Copy of International Search Report for PCT Application No. PCT/GB2005/0211793.

*Primary Examiner*—Ted Kavanaugh
(74) *Attorney, Agent, or Firm*—Alston & Bird LLP

(57) ABSTRACT

An insole includes a heel collar formed by a relatively hard bottom member and a softer top member, the heel collar underlying the heel and arch region and having a channel in its upper surface. A forefoot pad has a forward portion that underlies the forefoot and a rear portion that fits in the channel of the heel collar and is adhered therein. Relatively softer foam pads are disposed within recesses in the lower surface of the forefoot pad in the forefoot and heel strike areas. A footwear system can include the insole in combination with a knit sock having thick padded ball and heel portions and a thinner arch portion, and the insole has an upper surface contoured to abuttingly mate with the sock. The footwear system can also include a shoe in combination with the insole, where the shoe functions to enhance the benefits of the insole.

24 Claims, 4 Drawing Sheets

U.S. PATENT DOCUMENTS

| | | | | |
|---|---|---|---|---|
| 6,176,025 | B1 * | 1/2001 | Patterson et al. | 36/28 |
| 6,282,816 | B1 | 9/2001 | Rosendahl | |
| 6,301,805 | B1 * | 10/2001 | Howlett et al. | 36/43 |
| 6,408,543 | B1 * | 6/2002 | Erickson et al. | 36/100 |
| 6,481,120 | B1 | 11/2002 | Xia et al. | |
| 6,802,138 | B1 * | 10/2004 | McManus et al. | 36/28 |
| 2002/0007569 | A1 | 1/2002 | Crane et al. | |
| 2002/0056208 | A1 | 5/2002 | Brown | |
| 2003/0005599 | A1 | 1/2003 | Panaccione | |
| 2003/0041481 | A1 | 3/2003 | Evans et al. | |

FOREIGN PATENT DOCUMENTS

| | | |
|---|---|---|
| EP | 0 774 219 A | 5/1997 |
| LU | 32 199 A | 5/1953 |
| WO | WO 95 02974 | 2/1995 |

* cited by examiner

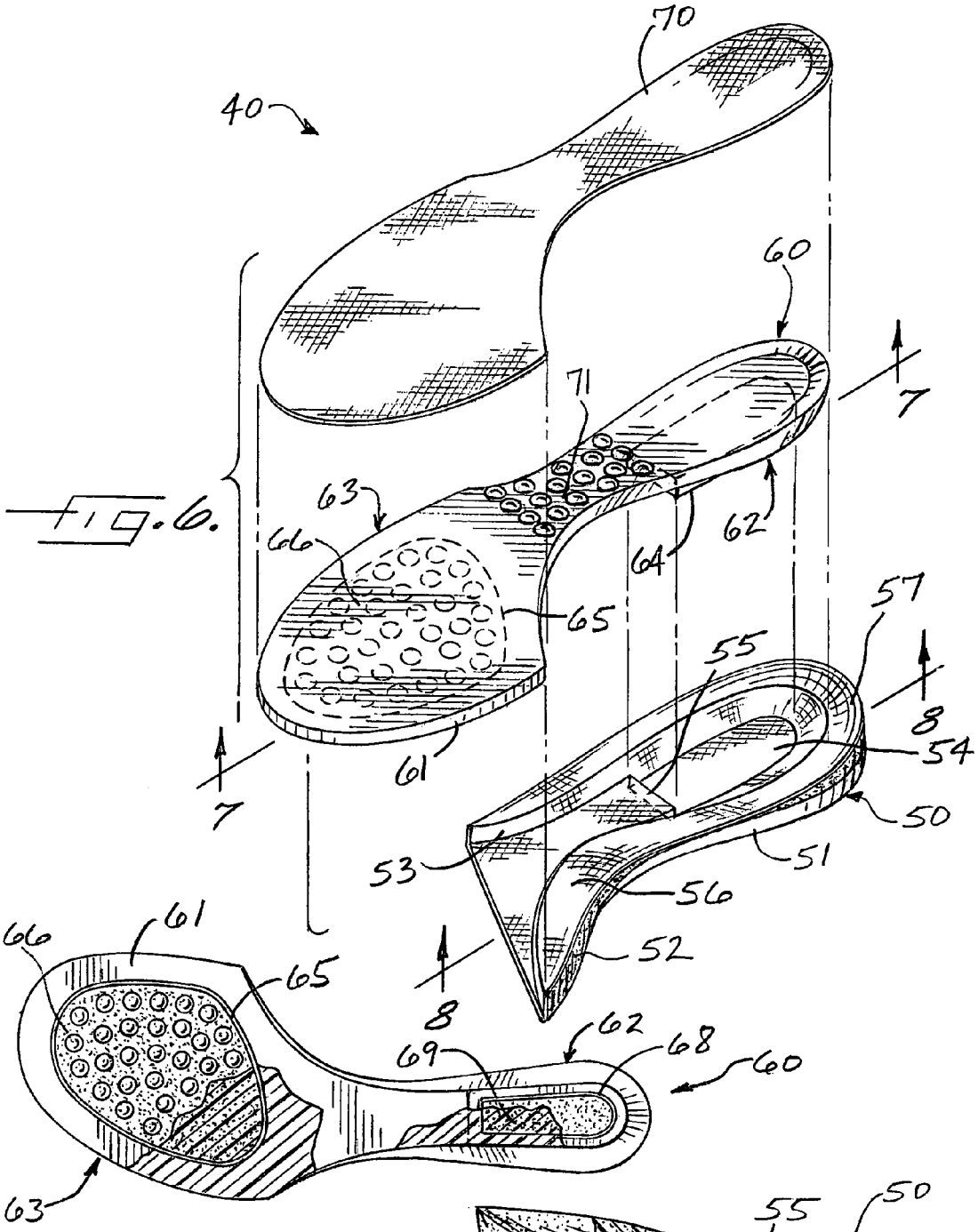
Fig. 6.
Fig. 7.
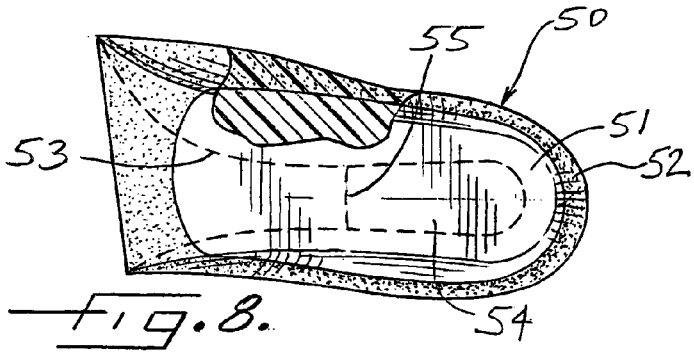
Fig. 8.

INSOLE, AND FOOTWEAR SYSTEM INCORPORATING SAME

BACKGROUND OF THE INVENTION

The present invention relates to footwear, and particularly to an insole for a shoe, an insole and sock system, an insole and shoe system, and an insole, sock, shoe system.

In recent years it has become increasingly common for shoes to be made with removable insoles, also referred to as sock liners or footbeds. This is particularly true of athletic shoes such as running shoes or the like, where the wearer may often desire to remove the "stock" insole supplied with the shoe and replace it with a different or better-quality insole providing a greater degree of cushioning and support. Stock insoles are usually quite inexpensive and do not offer as much cushioning and support as many wearers may desire or need.

A considerable amount of attention has been directed toward improving insoles in terms of cushioning and support. Additionally, for correct biomechanical functioning of the foot/ankle/leg, it is important to maintain proper foot alignment and structure throughout the gait. This proper foot alignment and structure is referred to herein as the "natural foot structure", and a gait having such natural foot structure is referred to as a "natural gait." Stock insoles typically are not particularly effective at maintaining natural foot structure, nor are the integral arch supports that are included in some shoes. The objectives of many replacement type insoles are to enhance cushioning and support and to help maintain the foot in proper alignment. A variety of insoles are available on the market that purport to achieve these objectives.

BRIEF SUMMARY OF THE INVENTION

The present invention provides a particularly effective insole, and a footwear system incorporating the insole and a sock and/or a shoe. The insole can be configured to be suitable for use as a replacement type insole in various types of shoes, or can be permanently affixed within a shoe as part of the shoe manufacturing process. The insole provides substantial cushioning and impact dissipation in the critical areas of the foot where forces tend to be the greatest, and also helps to maintain natural foot structure, which facilitates a natural gait.

In one embodiment of the invention, the insole includes a heel collar structured and arranged to extend beneath the heel and arch of the foot but terminate short of the ball of the foot. The heel collar comprises a bottom member that forms the lower surface of the heel collar and a top member that lies atop the bottom member. The lower surface of the heel collar advantageously is substantially planar or flat throughout, including the portion that underlies the arch region of the foot, so that the heel collar is not susceptible to collapsing under weight. The bottom member and top member comprise polymer foams, preferably relatively light-weight (i.e., low-density) foams such as EVA or polyethylene. The bottom member is relatively harder than the top member. The bottom member of the heel collar in preferred embodiments is configured to wrap partially up the sides of the heel collar around the edge of the heel collar that surrounds the user's heel, to impart enhanced structural support to this area of the insole. The heel collar preferably is shaped to cradle the heel, and to support the navicular bone and arch of the foot to help prevent pronation and flattening out of the foot on flat, hard surfaces when the foot is bearing weight during a stride.

The insole also includes a forefoot pad having a rear end overlying and joined to the heel collar, and having a forward end that extends beyond the heel collar and provides support for the forefoot region of the foot. The rear end of the forefoot pad is positioned to underlie the heel. The primary component of the forefoot pad comprises a layer formed of a polymer foam, preferably a durable and resilient foam such as urethane, viscoelastic, etc. The layer of polymer foam defines a forward recess in a lower surface of the forward end of the polymer foam layer and a rear recess in the lower surface under the heel. A foam pad is affixed within each of the forward and rear recesses in the polymer foam layer, the foam pads being relatively softer than the polymer foam layer and positioned to underlie the heel strike area and metatarsal heads of the foot to provide cushioning and support.

In a preferred embodiment, the heel collar defines a longitudinal channel in the upper surface that extends forward from a point beneath the heel of the foot, and the rear end of the forefoot pad is shaped in complementary fashion to the channel and is affixed within the channel to join the heel collar and forefoot pad together. The rear end defines the rear recess having the foam pad for the heel strike area. The rear end of the forefoot pad can be adhesively or mechanically affixed in the channel of the heel collar, after separately making the forefoot pad and the heel collar. As noted, the heel collar comprises only two different polymer materials of different densities and/or hardnesses, and the forefoot pad comprises two different polymer materials (or potentially three different materials if the foam pads in the forefoot and heel recesses are of different materials from each other). The finished insole, however, potentially can comprise four or more different polymer materials of different properties, such that a great deal of flexibility and versatility is afforded for selecting materials with optimum properties for the various regions of the foot that require different degrees of cushioning, impact dissipation, and support, in order to help facilitate a more-natural gait.

In one embodiment, the channel widens in a forward direction and the forefoot pad is configured to substantially fill the channel. At the forward end of the heel collar, the channel can occupy substantially the full width of the heel collar.

As noted, the invention also provides a footwear system. The system includes an insole as described above, in combination with a knit sock. The knit sock comprises a ball portion, a heel portion, and an arch portion disposed between the ball and heel portions, each of the ball and heel portions being formed of thicker knit fabric than the arch portion thereby providing a greater amount of protection and cushioning to overlying ball and heel portions of the foot of the wearer than to an overlying arch portion when positioned on the foot of a wearer. In the arch portion there is less knit fabric, leading to more control (i.e., less sliding of the fabric relative to the foot) and a better fit in this region. The sock follows the natural anatomical design of the foot.

The insole of the system includes a ball portion, a heel portion, and a raised arch portion, upper surfaces of each of the ball, heel and raised arch portions being positioned and arranged to receive respective lower overlying portions of the knit sock and to abuttingly contact the same, the raised arch portion of the insole corresponding substantially to the lengthwise extent of the arch portion of the knit sock when positioned on the foot of a wearer so as to provide an abuttingly mating interfacing relationship between the sock and insole for added protection and comfort to the wearer. The sock and insole together complement the anatomy of the foot to provide natural support and promote a more-natural gait.

The invention also provides a footwear system that includes the insole with a shoe specially designed to facilitate the proper functioning of the insole. In particular, as noted, an important feature of the insole is its resistance to collapsing under weight so that the foot is supported in a position approximating its natural non-weight-bearing position. To this end, the shoe of the system has a bottom surface in the medial arch region of the foot that is substantially flush with the rest of the bottom surface, thereby providing firm collapse-resistant support to the insole in the critical medial arch region. The shoe preferably also has a bevel on the rear lateral portion of the heel bottom surface, which helps impart a desired degree of inward rolling of the foot following initial heel strike. Additionally, the shoe in the forefoot region preferably has a relatively high degree of flexibility so as not to prevent the natural flexing of the toes and ball of the foot during the last push-off phase of the gait.

When used together as a complete footwear system, the insole, shoe, and sock provide maximum benefit in reducing abnormal pronation and collapsing of the foot under weight, and facilitate a more natural gait.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 2:
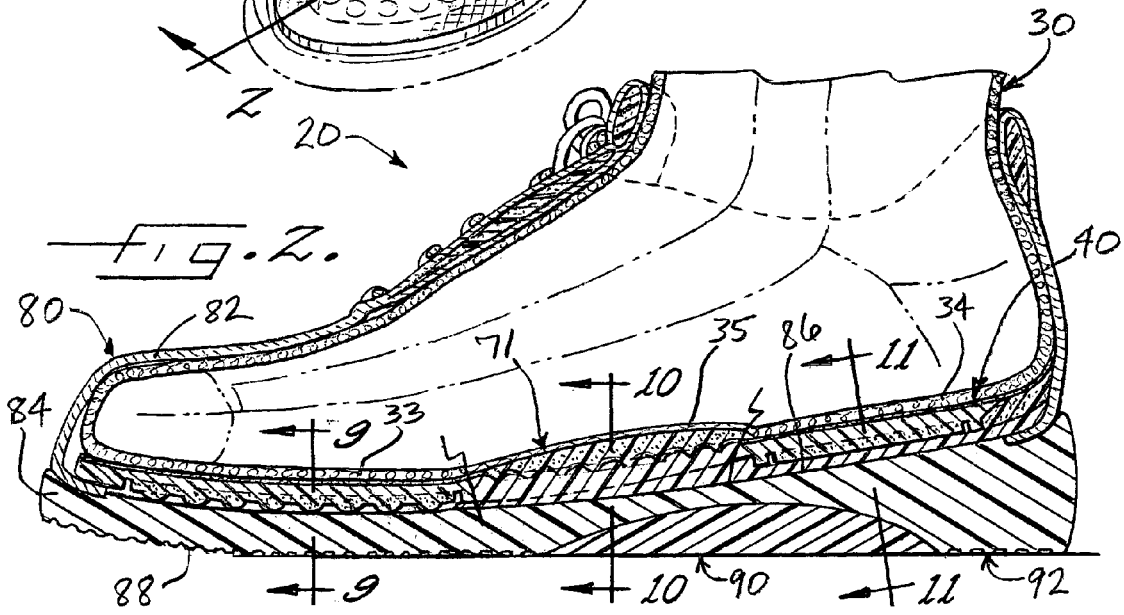
FIG. 2 is a cross-sectional view taken on line 2—2 in FIG. 1.
Figure 3:
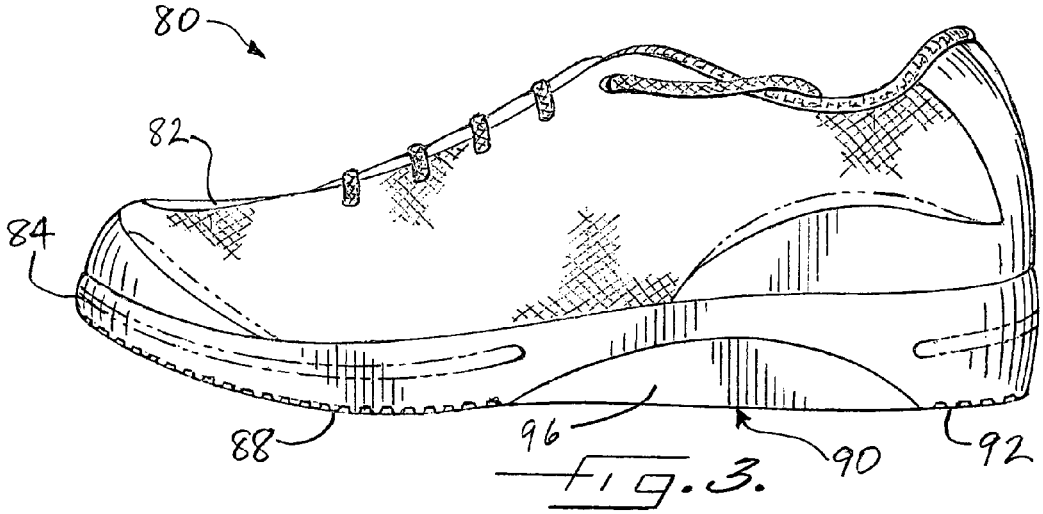
Figure 4:
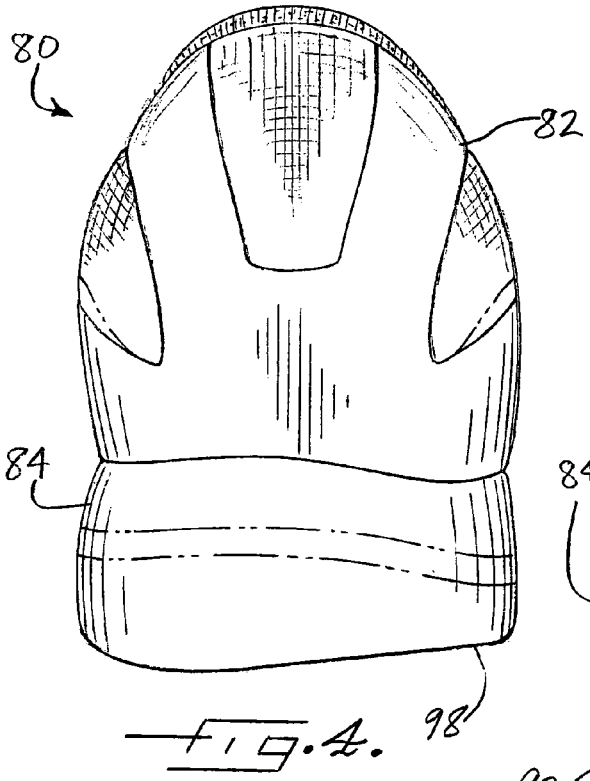
Figure 5:
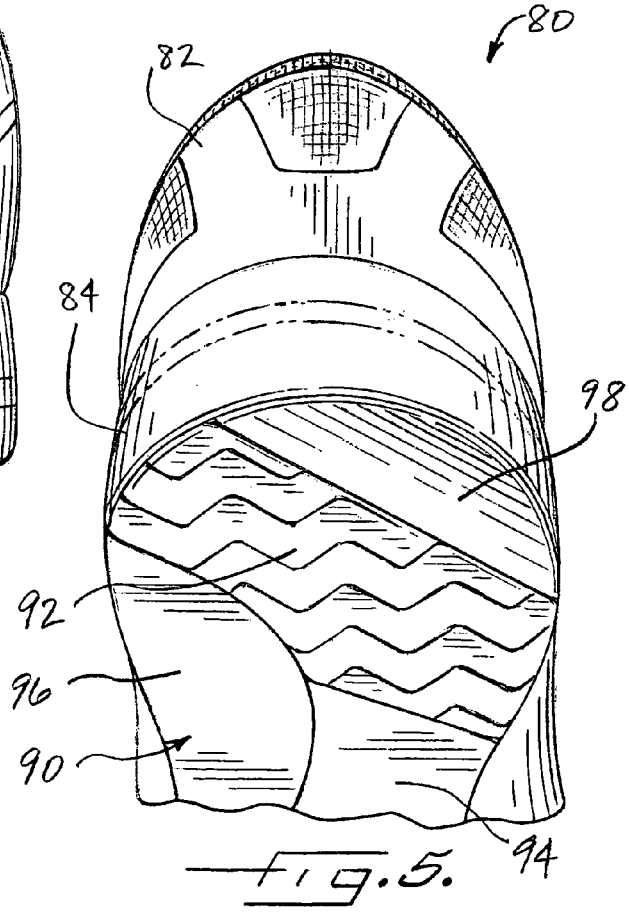
Figure 9:
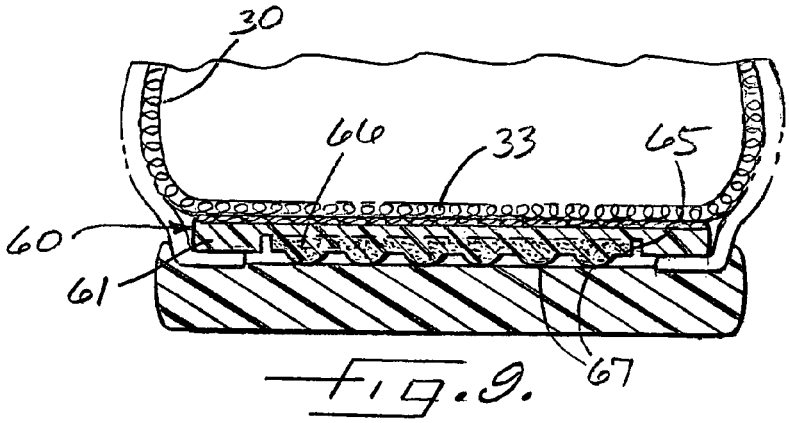
Figure 10:
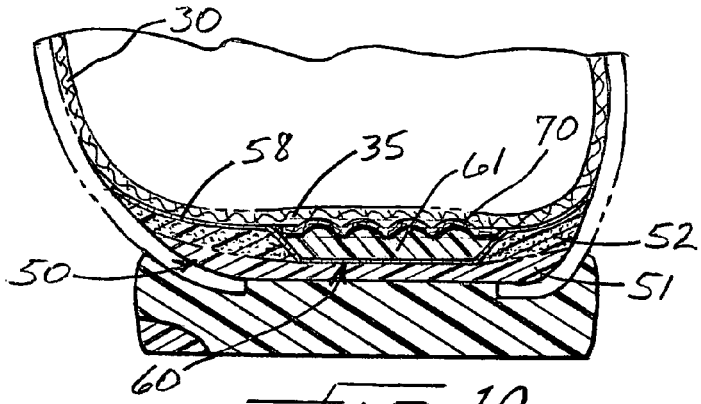
Figure 11:
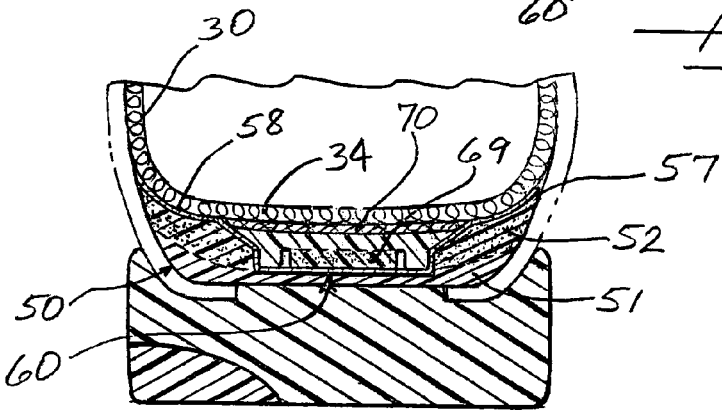
Figure 12:
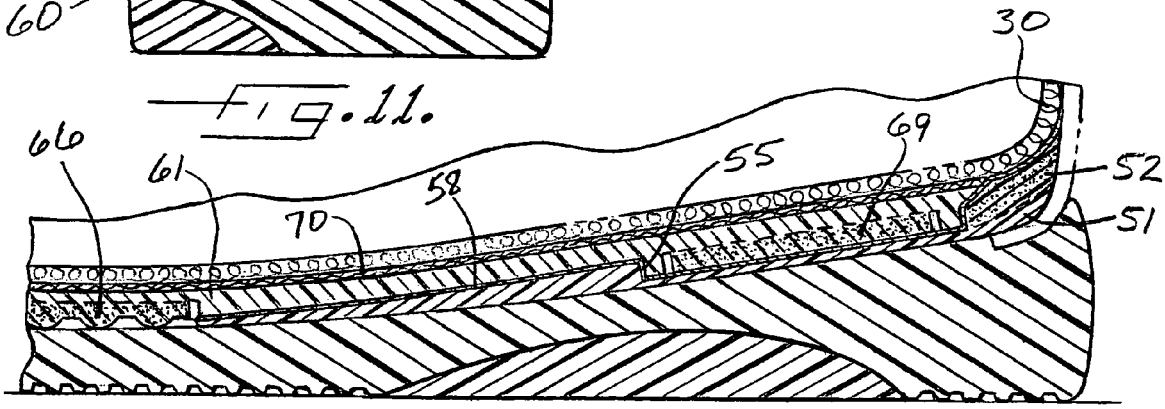

FIG. 3 a side elevation of a right-hand shoe, viewed from the medial side looking laterally, in accordance with one embodiment of the invention;

FIG. 4 is a rear elevation of the shoe;

FIG. 5 is a perspective view of the heel region of the shoe, generally from beneath looking upward and forward;

FIG. 6 is an exploded view of an insole in accordance with an embodiment of the invention;

FIG. 7 is a bottom elevation, viewed from line 7—7 in FIG. 6, of the forefoot pad of the insole;

FIG. 8 is a bottom elevation, viewed from line 8—8 in FIG. 6, of the heel collar of the insole;

FIG. 9 is a cross-sectional view along line 9—9 in FIG. 2;

FIG. 10 is a cross-sectional view along line 10—10 in FIG. 2;

FIG. 11 is a cross-sectional view along line 11—11 in FIG. 2; and FIG. 12 is a view similar to FIG. 2, on an enlarged scale.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
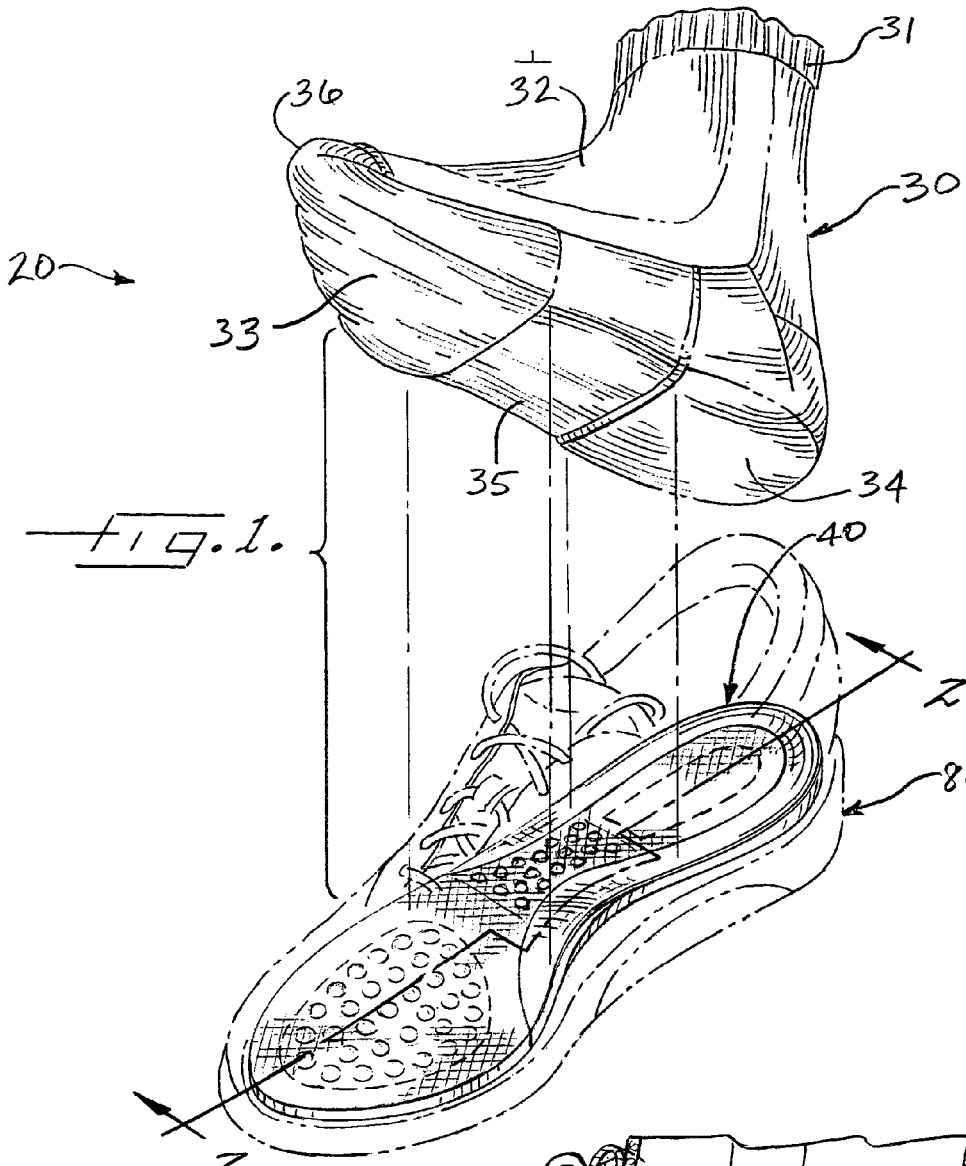
FIG. 1 is an exploded perspective view of an insole, shoe, and sock system in accordance with one embodiment of the invention, wherein the shoe component is shown in phantom lines for clarity of illustration.

FIGS. 1 and 2 depict an insole, shoe, and sock system 20 in accordance with one embodiment of the invention. The system includes a knit sock 30, an insole 40, and a shoe 80. The sock 30 is illustrated as an athletic sock. The sock 30, however, can be knit for use as a dress sock or other varieties of socks as understood by those skilled in the art. The sock 30 preferably is knit similar to the sock disclosed in U.S. Pat. No. 5,335,517 entitled "Anatomical Isotonic Sock", which is hereby incorporated herein by reference. The sock may also be knit similar to the sock disclosed in U.S. Pat. No. 4,194,249 entitled "Jogging and Running Athletic Sock", which is hereby incorporated herein by reference.

As shown in FIGS. 1–2, the knit sock 30 preferably has a leg including an upper cuff 31 which may be a true rib or a mock rib construction integrally knit with a foot which includes an instep portion 32, a toe portion 36, a ball portion 33, a heel portion 34, and an arch portion 35 disposed between the ball and heel portions 33, 34. The arch portion 35 is preferably formed of one set of raised terry loops, but the arch portion may also be devoid of terry loops. The sock 30 is preferably knit throughout with a stretchable body yarn formed of nylon, spandex, or acrylic, but the sock 30 may also be formed of various other types of yarns throughout, such as acrylic, cotton, or a combination of yarns.

Each of the ball and heel portions 33, 34 of the knit sock 30 is formed of thicker knit fabric than the arch portion 35. The thicker knit fabric is preferably a predetermined density of raised terry loops, preferably two or more sets of raised terry loops, thereby providing a greater amount of protection and cushioning to the ball and heel of the foot of the wearer. The arch portion 35 may be formed of raised terry loops, but such as to be thinner and have less cushioning than the ball or heel portions 33, 34.

The insole 40 is shown in the shoe 80 in FIG. 2, and the shoe is shown in phantom lines in FIG. 1. The insole can be a replacement type of insole that is inserted into the shoe by the wearer but is not affixed within the shoe. Alternatively, the insole can be affixed in the shoe either in the shoe factory or elsewhere, and can be affixed by various techniques including but not limited to adhesive, hook-and-loop fastening systems (e.g., VELCRO®), or others.

With particular reference to FIGS. 6–12, the insole 40 comprises a heel collar 50 and a forefoot pad 60 that overlies the heel collar and is affixed thereto. The heel collar 50 preferably comprises relatively lightweight polymer foam materials, and has a multiple-density structure. More particularly, the heel collar comprises a bottom member 51 formed of a polymer foam having a relatively higher density and durometer hardness, and a top member 52 overlying and joined to the bottom member and formed of a polymer foam having a relatively lower density and durometer hardness. The bottom member 51 is sized and shaped to underlie the heel region and at least a portion of the arch region of the foot. The relatively hard material of the bottom member 51 gives the bottom member substantial firmness and resistance to deformation so that the bottom member forms a firm foundation for the heel collar 50. The lower surface of the bottom member advantageously is substantially planar or flat for lying flat atop the inner surface of a shoe, such that the heel collar is not susceptible to collapsing when bearing weight. The top member 52 of the heel collar preferably is slightly wider and longer than the bottom member 51 as shown, so that the user's foot contacts only the softer material of the top member 52. In particular, the top member advantageously extends beyond the bottom member in the forward direction (i.e., in the direction from heel to forefoot) as best seen in FIG. 5. Additionally, as shown in FIG. 8, the bottom member 51 preferably wraps partially up the sides of the heel collar along the edge of the heel collar that extends around the heel, so as to enhance the structural support of the heel collar in this region.

The heel collar 50 defines a channel 53 in its upper surface. The channel 53 extends from the forward end of the heel collar rearward, and terminates in the heel region that underlies the wearer's heel. In the illustrated embodiment, the channel is relatively narrow at the rear end of the heel collar and even narrower through the arch region, but then widens in the forward direction such that at the forward end of the heel collar, the channel occupies substantially the full width of the heel collar. The portion of the channel 53 at the forward end of the heel collar is relatively shallow. A rear end portion 54 of the channel is relatively deeper and there is an abrupt step 55 between the deeper rear end portion 54 and the rest of the channel, for purposes to be explained. The heel collar 50 preferably also defines a raised arch portion 56 to help support the arch of the wearer's foot, and around the periphery of the heel region the heel collar advantageously has a substantially thickened rim 57 that cradles the heel. The heel collar 50 also can include a top layer 58 of a non-polymer foam material; the top layer 58 preferably has a low coefficient of friction and a relatively high resistance to abrasion.

Various materials can be used for the bottom member 51 and top member 52 of the heel collar. The members generally comprise relatively lightweight polymer foams based on polymers such as polyethylene, ethylene vinyl acetate (EVA), and the like. As noted, the bottom member 51 advantageously has a higher hardness than the top member 52. For instance, the bottom member can have an Asker C durometer hardness that is about 10 to about 50 points higher than that of the top member. As an example, the bottom member 51 can comprise an EVA foam having an Asker C hardness of about 80–100, and the top member 52 can comprise an EVA foam having an Asker C hardness of about 50–70.

The forefoot pad 60 of the insole comprises a polymer foam layer 61 that preferably is more resilient and softer (i.e., lower durometer hardness) than the heel collar material. The polymer foam layer 61 can comprise various polymer foams such as urethane, viscoelastic, and the like. The forefoot pad has a rear portion 62 and a forward portion 63. The rear portion 62 is configured in complementary fashion to the channel 53 in the heel collar of the insole, and fits within the channel so that the upper surface of the rear portion 62 and the upper surface of the heel collar 50 are substantially flush with each other. The rear portion 62 is affixed within the channel by any suitable means such as adhesive, mechanical fastening devices, or the like. The rear portion 62 has a relatively thick portion 64 configured to fit into the deeper part 54 of the channel, and there is an abrupt step between the thick portion 64 and the rest of the rear portion 62 that corresponds to the step 55 in the channel. The steps help prevent the forefoot pad 60 from sliding forward in the channel 53, and either alone or together with other fastening means such as adhesive or hook-and-loop or the like, thereby help to keep the forefoot pad in its proper position with respect to the heel collar.

The foam layer 61 of the forefoot pad defines a forward recess 65 in its lower surface at the location that underlies the ball of the wearer's foot. A foam pad 66 is affixed within the recess 65. The foam pad 66 comprises a polymer foam having a relatively lower hardness than that of the foam layer 61, and is positioned to underlie the metatarsal heads of the foot and surrounding regions. The foam pad 66 advantageously comprises a polymer foam having a high degree of impact dissipation. Suitable materials include urethane, viscoelastic (e.g., SORBOTHANE®), and the like. The foam pad 66 can include downwardly projecting dimples 67 for frictionally gripping the inner surface of the shoe to help prevent the insole from slipping relative to the shoe during use. The foam pad 66 can be separately formed and then affixed in the recess by adhesive or the like, but more preferably the foam pad is directly molded in the recess.

The foam layer 61 of the forefoot pad 60 also includes a recess 68 in the lower surface of the thick portion 64, and a foam pad 69 is affixed within the recess by adhering a separately formed pad in the recess or more preferably by directly molding the pad in the recess. The foam pad 69 is positioned to underlie the heel strike area (calcaneus) of the foot. The foam pad 69 has a lower hardness than that of the polymer foam layer 61 and advantageously comprises a polymer foam having a high degree of impact dissipation. Suitable materials include urethane, viscoelastic (e.g., SORBOTHANE®), and the like.

The foam pads 66, 69 can have an Asker C durometer hardness about 10 to about 30 points lower than that of the foam layer 61. As an example, the foam layer 61 can comprise a urethane foam having an Asker C hardness of about 30–50 and the pads 66, 69 can comprise a urethane foam having an Asker C hardness of about 20–40.

The forefoot pad 60 of the insole can also include a top layer 70 of non-foam material adhered to the polymer foam layer 61. The top layer 70 advantageously is a material having a low coefficient of friction and a high abrasion resistance.

The forefoot pad 60 can include a raised arch portion 71 that cooperates with the raised arch portion 56 of the heel collar to form a raised arch contoured to complement the shape of a wearer's arch. The resulting raised arch portion of the insole is located in registration with the arch portion 35 of the sock 30 of the insole/sock system. The forefoot and heel regions of the insole's upper surface are lowered relative to the arch region so as to accommodate the relatively greater thickness of the ball portion 33 and heel portion 34 of the sock. Thus, the upper contour of the insole is complementary to the contour of the lower surface of the sock such that an abuttingly mating interface is provided therebetween.

The invention thus provides an insole of two-piece, multi-density (e.g., four-density in preferred embodiments) construction that provides a combination of cushioning and support benefits, designed in a way to give the user's foot a natural-gait while bearing weight on hard surfaces. The heel collar comprises relatively firmer foam than the forefoot pad, and comprises lightweight material such as EVA or polyethylene foam, such that a substantial degree of support is achieved while keeping the heel collar relatively light in weight. The heel collar is made in two densities so that the bottom layer, wrapping partially up the sides of the component, can be made of even a higher-durometer material to add more structural support to this area of the insole. The shape of the heel collar is designed to cradle the heel of the foot and to support the navicular bone and arch of the foot to help prevent pronation and flattening out of the foot on hard surfaces in a weight bearing position. The forefoot pad, which also overlaps with the heel collar under the middle part of the heel area, is designed to provide a primary function of cushioning and protecting the heel and metatarsal heads in the high-pressure impact areas. The core of the forefoot component is made of a softer foam, which provides more resilience and more-durable cushioning properties than the heel collar material. In addition, the softer elastomer pads under the heel and metatarsal heads provide a further level of cushioning in these high-pressure impact areas. The upper surface of the finished insole (heel collar and forefoot pad combined) is contoured in the heel and ball area to accommodate thick padded regions of the specially designed sock, thus further enhancing the cushioning and support benefits to the user when used as a system.

The insole, and the insole/sock system, are suitable for use with various types of shoes including athletic shoes, walking shoes, casual-wear shoes, and others. Existing shoes of these types can be used with the insole and insole/sock system. However, the insole and system function better when used in a shoe that is particularly designed to enable the insole to work as intended. The invention thus also provides an insole/shoe system and an insole/shoe/sock system wherein the shoe component is specially designed to maximize the benefit of the insole and insole/sock system.

The shoe 80 will now be described with particular reference to FIGS. 2–5. The shoe 80 comprises an upper 82 and an outsole 84. The upper can be constructed from various materials including manmade and natural materials, and can have various styles. The particular configuration of the upper is not important to the invention, except to the extent that the upper should be sized and shaped to closely surround the outer periphery of the insole so there are no substantial gaps therebetween, and should be relatively flexible through the forefoot region so as not to interfere with flexing of the outsole in this region, as further described below.

The outsole 84 is affixed to the upper by gluing and/or stitching or the like. The upper surface 86 of the outsole defines the inner surface of the shoe on which the insole 40 is supported. As such, the upper surface 86 preferably should be shaped to substantially match the generally flat shape of the lower surface of the insole, such that the outsole forms a stable foundation for the insole so as to minimize rocking of the insole either side-to-side or front-to-back. The outsole preferably is formed of one or more polymer materials of relatively high durometer hardness and preferably has shock-absorbing characteristics. The forefoot region of the outsole preferably is relatively flexible so as not to interfere with or prevent the flexing of the forefoot and toes during the push-off portion of the gait. Such flexibility can be provided through suitable design of the outsole thickness and tread as known in the art, and by minimizing the amount of components in the forefoot, including a separately adhered rubber outsole.

The lower surface 88 of the outsole is of particular significance to the invention. As noted, the insole 40 is designed to support the foot in a position approximating its natural non-weight-bearing position, and as such it is important that the insole not collapse under weight, particularly through the medial arch region. Many shoes tend to have a void or concave region under the medial arch portion of the foot, and hence can be susceptible to at least partially collapsing in this area when bearing weight. The outsole 84 of the shoe in accordance with the invention is configured to be substantially flat through the medial arch region, such that the medial arch region 90 of the lower surface is substantially flush with the adjacent heel region 92 and lateral arch or midfoot region 94 (FIG. 5). If desired, the outsole can include a medial arch portion 96 that is integrally joined with the remainder of the outsole but differs in one or more respects from the other parts of the outsole. For instance, the medial arch portion 96 can differ from the rest of the outsole in color or other aesthetic characteristics, and/or it can differ in functional characteristics such as durometer hardness, shock-absorbing performance, or others. The medial arch portion 96 can comprise a different polymer material from that of the other parts of the outsole.

The outsole 84 preferably also has a beveled region 98 at the rear lateral side of the heel where initial heel strike occurs in a natural gait. The beveled region 98 is generally planar and is inclined relative to the rest of the heel as best seen in FIG. 4. More particularly, the beveled region is inclined in a direction that extends generally rearwardly and laterally. The beveled region is the first part of the heel to strike the ground during a walking gait, and for most people is also the first part to strike the ground during a running gait. At this initial heel strike, the shoe tends to assume an orientation that is rolled laterally outwardly (i.e., clockwise in FIG. 4) an amount dictated by the angle of the bevel As the gait proceeds from initial heel strike and more and more of the shoe's bottom surface comes into contact with the ground, the shoe then tends to roll inwardly to the position shown in FIG. 4. The design of the shoe thus promotes a controlled moderate degree of rolling motion of the foot so that the movement from heel strike to toe push-off is stable and repeatable. This allows the foot to be in an advantageous position through all phases of the gait.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An insole for a shoe, comprising:

a heel collar structured and arranged to extend beneath the heel and arch of the foot but terminate short of the ball of the foot, the heel collar defining an upper surface and a lower surface and comprising a bottom member that forms the lower surface of the heel collar and a top member that lies atop the bottom member, the bottom member and top member comprising polymer foam and the bottom member being relatively harder than the top member; and a forefoot pad having a rear end overlying and attached to the heel collar, and having a forward end that extends beyond the heel collar and provides support for the forefoot region of the foot, the forefoot pad comprising a polymer foam layer defining a forward recess in a lower surface of the forward end of the polymer foam layer and a rear recess in the lower surface of the rear end under the heel, the forefoot pad further comprising a foam pad affixed within each of the forward and rear recesses in the polymer foam layer, the foam pads being relatively softer than the polymer foam layer and positioned to underlie the heel strike area and metatarsal heads of the foot to provide cushioning and support.

2. The insole of claim 1, wherein the top and bottom members of the heel collar comprise ethylene vinyl acetate foam.

3. The insole of claim 1, wherein the heel collar defines a longitudinal channel in the upper surface that extends forward from a point beneath the heel of the foot, and the rear end of the forefoot pad is shaped in complementary fashion to the channel and is adhesively or mechanically affixed within the channel to join the heel collar and forefoot pad together.

4. The insole of claim 3, wherein the channel widens in a forward direction and the rear end of the forefoot pad is configured to substantially fill the channel.

5. The insole of claim 4, wherein the channel at a forward end of the heel collar occupies substantially the full width of the heel collar.

6. The insole of claim 3, wherein a rear portion of the channel is deeper than the remainder of the channel, and a corresponding portion of the rear end of the forefoot pad, which has the foam pad for the heel strike area, is thicker than the remainder of the rear end and fits into the rear portion of the channel.

7. The insole of claim 1, wherein the insole defines a raised arch portion.

8. The insole of claim 1, wherein the bottom member of the heel collar has a smaller lengthwise extent than the top member of the heel collar, the top member extending beyond the bottom member in a forward direction.

9. The insole of claim 1, wherein the bottom member of the heel collar is configured to extend fully beneath the heel of a user's foot.

10. The insole of claim 1, wherein the forefoot pad further comprises a top layer of non-foam material affixed atop the polymer foam layer.

11. The insole of claim 1, wherein the forefoot pad has a lower durometer hardness than the heel collar.

12. A footwear system, comprising:

an insole in accordance with claim 1; and a shoe in which the insole is disposed, the shoe comprising an upper and an outsole affixed to the upper, the outsole defining a lower surface, the lower surface defining a heel region, a lateral arch region, a medial arch region, and a forefoot region, wherein the medial arch region of the lower surface is substantially flush with the heel and lateral arch regions of the lower surface.

13. The footwear system of claim 12, wherein the heel region of the outsole lower surface includes a beveled region at a rear lateral side of the heel region, the beveled region being inclined relative to the rest of the heel region in a direction generally rearwardly and laterally.

14. The footwear system of claim 12, wherein the shoe in the forefoot region is flexible so as not to prevent flexing of the toes and ball of the foot during a natural gait.

15. An insole and sock system, comprising:

(a) an insole comprising:

a heel collar structured and arranged to extend beneath the heel and arch of the foot but terminate short of the ball of the foot, the heel collar defining an upper surface and a lower surface and comprising a bottom member that forms the lower surface of the heel collar and a top member that lies atop the bottom member, the bottom member and top member comprising polymer foam and the bottom member being relatively harder than the top member; and a forefoot pad overlying and joined to the heel collar, and having a forward end that extends beyond the heel collar and provides support for the forefoot region of the foot, the forefoot pad comprising a polymer foam layer defining a forward recess in a lower surface of the forward end of the polymer foam layer and a rear recess in the lower surface under the heel, the forefoot pad further comprising a foam pad affixed within each of the forward and rear recesses in the polymer foam layer, the foam pads being relatively softer than the polymer foam layer and positioned to underlie the heel strike area and metatarsal heads of the foot to provide cushioning and support; and (b) a knit sock comprising a ball portion, a heel portion, and an arch portion disposed between the ball and heel portions, each of the ball and heel portions being formed of thicker knit fabric than the arch portion thereby providing a greater amount of protection and cushioning to overlying ball and heel portions of the foot of the wearer than to an overlying arch portion when positioned on the foot of a wearer.

16. The insole and sock system of claim 15, wherein the insole comprises a ball portion, a heel portion, and a raised arch portion, upper surfaces of each of the ball, heel and raised arch portions being positioned and arranged to receive respective lower overlying portions of the knit sock and to abuttingly contact the same, the raised arch portion of the insole corresponding substantially to the lengthwise extent of the arch portion of the knit sock when positioned on the foot of a wearer so as to provide a substantially mating interfacing relationship for added protection and comfort to the wearer.

17. The insole and sock system of claim 15, wherein the heel collar of the insole defines a longitudinal channel in the upper surface that extends forward from a point beneath the heel of the foot, and a rear end of the forefoot pad of the insole is shaped in complementary fashion to the channel and is affixed within the channel to join the heel collar and forefoot pad together.

18. The insole and sock system of claim 17, wherein the rear end of the forefoot pad of the insole is adhesively affixed in the channel of the heel collar.

19. The insole and sock system of claim 17, wherein the channel widens in a forward direction and the forefoot pad is configured to substantially fill the channel.

20. The insole and sock system of claim 19, wherein the channel at a forwardmost end of the heel collar occupies substantially the full width of the heel collar.

21. The insole and sock system of claim 15, wherein the bottom member of the heel collar of the insole has a smaller lengthwise extent than the top member of the heel collar, the top member extending beyond the bottom member in a forward direction.

22. A footwear system, comprising:

an insole and sock system in accordance with claim 15; and a shoe in which the insole is disposed, the shoe comprising an upper and an outsole affixed to the upper, the outsole defining a lower surface, the lower surface defining a heel region, a lateral arch region, a medial arch region, and a forefoot region, wherein the medial arch region of the lower surface is substantially flush with the heel and lateral arch regions of the lower surface.

23. The footwear system of claim 22, wherein the heel region of the outsole lower surface includes a beveled region at a rear lateral side of the heel region, the beveled region being inclined relative to the rest of the heel region in a direction generally rearwardly and laterally.

24. The footwear system of claim 22, wherein the shoe in the forefoot region is flexible so as not to prevent flexing of the toes and ball of the foot during a natural gait.

* * * * *